US006489857B2

(12) United States Patent
Petrarca et al.

(10) Patent No.: US 6,489,857 B2
(45) Date of Patent: Dec. 3, 2002

(54) MULTIPOSITION MICRO ELECTROMECHANICAL SWITCH

(75) Inventors: Kevin Petrarca, Newburgh, NY (US); Robert A. Groves, Highland, NY (US); Brian Herbst, Poughquag, NY (US); Christopher Jahnes, Upper Saddle River, NJ (US); Richard Volant, New Fairfield, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/727,165

(22) Filed: Nov. 30, 2000

(65) Prior Publication Data

US 2002/0063610 A1 May 30, 2002

(51) Int. Cl.[7] ..... H01P 1/10
(52) U.S. Cl. ..... 333/105; 333/262; 200/181
(58) Field of Search ..... 333/105, 262; 200/181; 335/154

(56) References Cited

U.S. PATENT DOCUMENTS 5,578,976 A 11/1996 Yao ..... 333/262
5,619,061 A * 4/1997 Goldsmith et al. ..... 257/528
5,695,810 A 12/1997 Dubin et al. ..... 427/96
5,946,176 A 8/1999 Ghoshal ..... 361/56
6,065,424 A * 5/2000 Shacham-Diamand et al. .. 118/696
6,069,540 A 5/2000 Berenz et al. ..... 333/101
6,128,961 A 10/2000 Haronian ..... 73/774
6,132,586 A 10/2000 Adams et al. ..... 205/123
6,143,997 A * 11/2000 Feng et al. ..... 200/181

OTHER PUBLICATIONS

Dimitrios Peroulis, Sergio Pacheco, Kamal Sarabandi, and Linda P.B. Kathehi, "Mems Devices for High Isolation Switching and Tunable Filtering", *IEEE*, 2000.

K.E. Petersen, "Micromechanical Membrane Switches on Silicon" *IBM J. Res. Develop.* vol. 23 No. 4, Jul. 1979.

Steven T. Walsh, Robert Boylan, and Stephen F. Bart "Overcoming Stiction in MEMS Manufacturing" Mar. 1995.

K. Komvopoulos and W. Yan "A Fractal Analysis of Stiction in Microelectromechanical Systems" *Journal of Tribology*, vol. 119 Jul. 1997.

* cited by examiner

*Primary Examiner*—Benny Lee
*Assistant Examiner*—Dean Takaoka

(57) ABSTRACT

A micro electromechanical switch has a guidepost formed upon a substrate. A signal transmission line is formed on the substrate, with the signal transmission line having a gap and forming an open circuit. The switch further includes a switch body having a via opening formed therein, with the switch body being movably disposed along an length defined by the guide post. The guidepost is partially surrounded by the via opening.

10 Claims, 6 Drawing Sheets

MULTIPOSITION MICRO ELECTROMECHANICAL SWITCH

BACKGROUND

The present disclosure relates generally to micro electromechanical (MEM) switches and, more particularly, to a multiposition MEM switch.

Advances in integrated circuit technology in recent years have led to the development of micro electromechanical systems (MEMS), featuring devices of micrometer dimensions which can be actuated and controlled using mechanical, electrostatic, electromagnetic, fluidic and thermal methods. MEMS manufacturing technologies are a combination of the more established semiconductor microfabrication techniques with the newer developments in micromachining.

One example of a MEM device is a cantilevered beam switch having one end anchored to a substrate material, such as silicon. The free end of the beam serves as a deflection electrode which, when a voltage source is applied thereto, deflects as a result of the electrostatic forces on the beam and a field plate, thereby making contact with a stationary electrode. When the voltage source is removed, the beam returns to its "rigid" state due to the restoring forces therein and the switch contacts are opened.

Although advances in MEM technology have been considerable in recent years, the technology is not without its drawbacks. For example, one of the most insidious problems facing manufacturers of MEMS devices is stiction, which occurs when a surface of a micromachined part (such as a cantilever beam) becomes fused or bonded to an adjacent surface of the structure. Stiction can often result from conditions such as surface roughness, humidity, applied voltage and capillary forces during the manufacturing process. The greater the number of stiction problems occurring in a device, the greater the overall effect on the yield of the device becomes. In addition, the physical geometry of a component itself may also have an effect on its susceptibility to stiction; switches of the cantilevered type may undergo warpage due to repeated mechanical stresses on the beam. As such, it is desirable to provide a switch design which minimizes the susceptibility to stiction.

Other difficulties associated with beam switches may include: material fatigue, space constraints (from the requirement for anchoring points), the creation of parasitic inductances and resonant frequency problems. It is also desirable, therefore, to provide a MEM switch which addresses the aforementioned concerns.

SUMMARY

In an exemplary embodiment, a micro electromechanical switch has a guidepost formed upon a substrate. A signal transmission line is formed on the substrate, with the signal transmission line having a gap and forming an open circuit. The switch further includes a switch body having a via opening formed therein, with the switch body being movably disposed along a length defined by the guidepost. The guidepost is partially surrounded by the via opening. In a preferred embodiment, a field plate is formed on the substrate and aligned electrostatically attractably apart from the switch body. An electrostatic attraction between the field plate and the switch body causes the switch body to close the gap in the signal transmission line.

DETAILED DESCRIPTION

Figure 1:
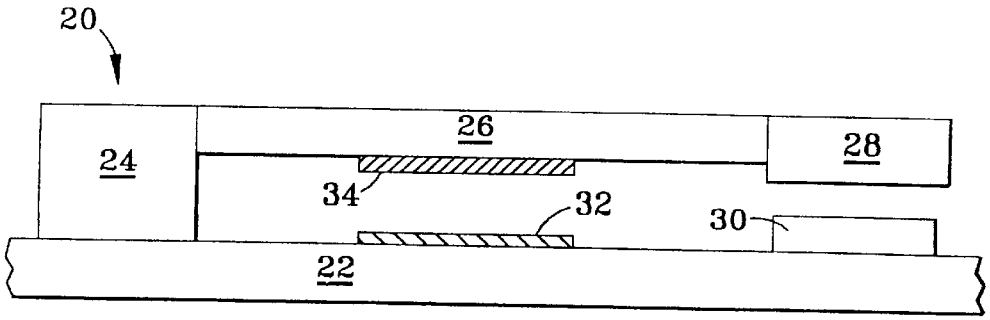
FIG. 1 PRIOR ART
FIG. 1 is a side elevational view of a prior art, cantilever beam microswitch.

FIG. 1 is illustrative of a known micro electromechanical switch (MEMS). As shown, the MEMS, generally identified by reference numeral 20, is formed on a substrate 22 with a fixed post 24 formed at one end. A flexible cantilever beam 26 is connected on one end of post 24. The cantilever beam 26 is adapted to carry an electrical contact 28 on one end that is aligned and adapted to mate with a corresponding contact 30 on substrate 22. The switch 20 is adapted to be activated electrostatically. A grounding plate 32 is formed on the substrate 22 while a filed plate 34 is formed on the cantilever beam 26. The grounding plate 32 is adapted to be connected to ground while the field plate 34 is adapted to be selectively coupled to a DC voltage source (not shown). With no voltage applied to the field plate 34, the contact 28 is separated from contact 30, defining an open circuit state. When an appropriate DC voltage is applied to field plate 34, the cantilever beam 26 is deflected by the electrostatic forces between plate 34 and ground plate 32, causing electrical contact 28 to mate with contact 30, defining a closed circuit state. When the applied voltage is subsequently removed from the field plate 34, the cantilever beam 26 returns to its static position due to the restoring forces in the beam.

Figure 2:
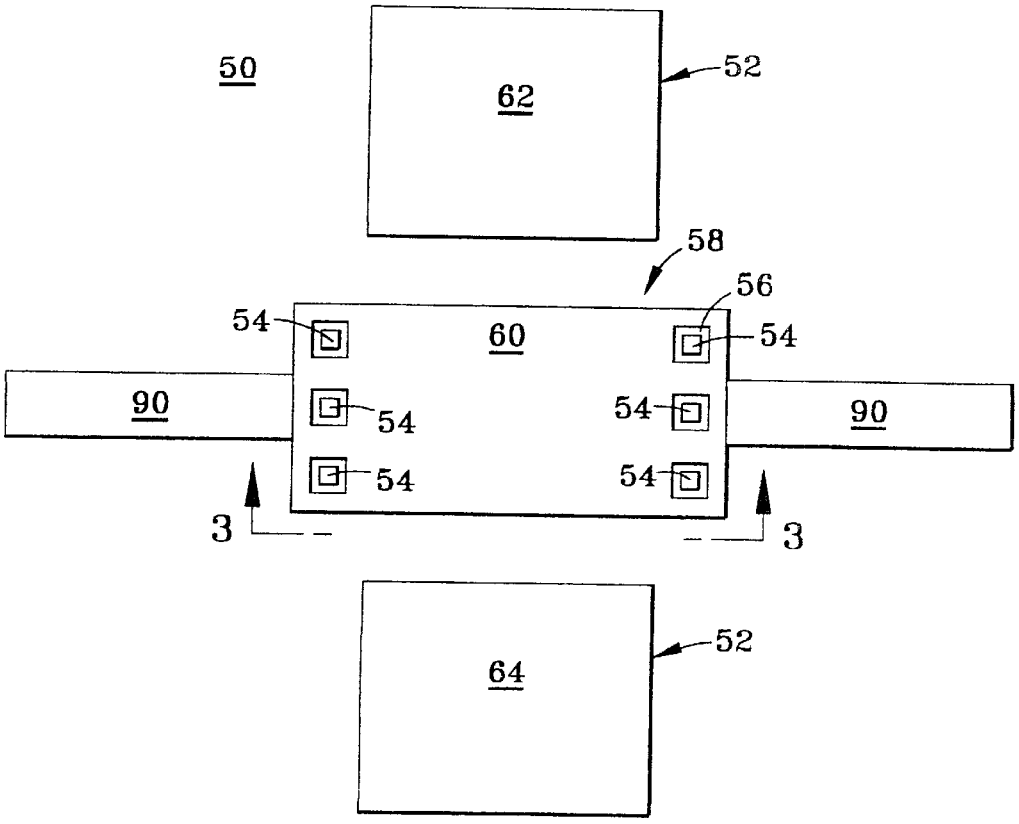
FIG. 2 is a top plan view of an embodiment of a micro electromechanical switch of the invention, with the upper and lower substrate levels exploded laterally to illustrate the main switch body.
Figure 3:
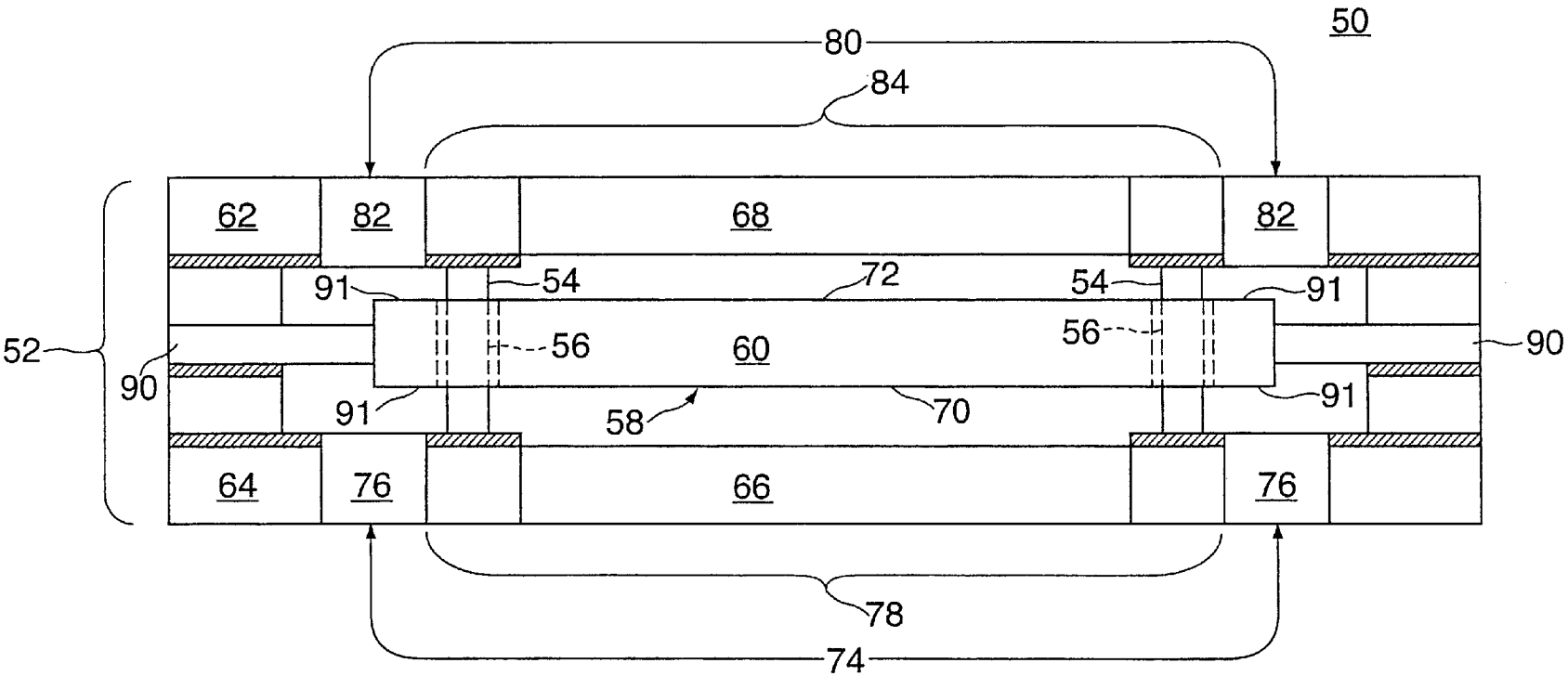
FIG. 3 is a cross sectional view of the switch of FIG. 2, taken along the section line 3—3.
Figure 4:
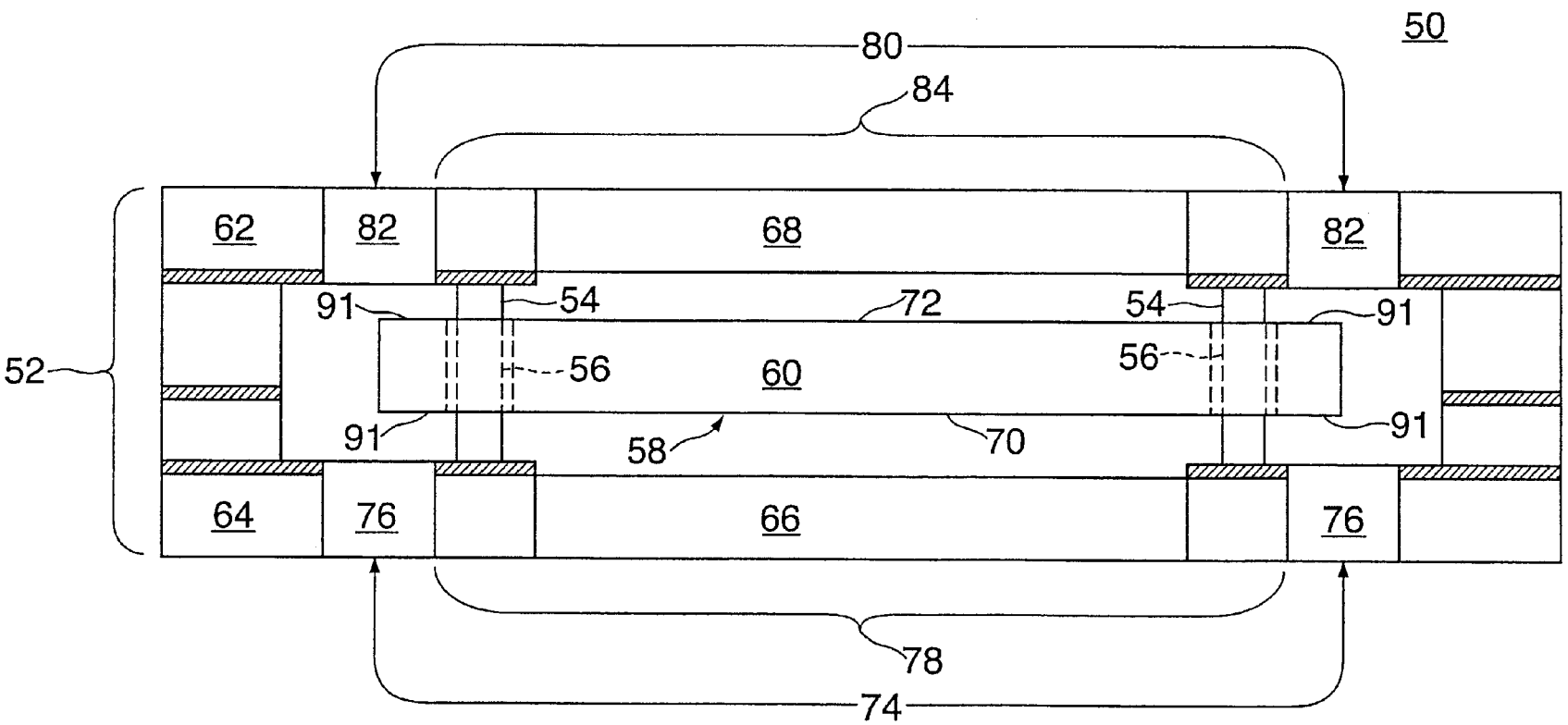
FIG. 4 is an alternative embodiment of the switch shown in FIG. 3.

Referring now to FIGS. 2 through 4, a switch 50 of an embodiment of the invention is fabricated upon a substrate 52, such as silicon dioxide ($SiO_2$), onto which a plurality of guideposts 54 are formed and located thereupon. Guideposts 54 are surrounded by via openings 56 formed within a moveable body 58 of switch 50. Body 58 is comprised of a generally rectangular block 60 of conducting material, such as copper. In order to prevent oxidation, the block 60 is encapsulated within an insulating layer and capped, as is described in greater detail hereinafter. As is best seen in FIGS. 3 and 4, body 58 is movably disposed along the length of the guideposts 54, which serve to keep the body 58 of switch 50 in proper lateral alignment as it travels vertically along the guideposts 54. Configured in this manner, switch 50 does not require an anchor or fixed point about which to pivot or flex.

Body 58 is disposed in a generally horizontal alignment between an upper layer 62 of the substrate 52 and a lower layer 64 of the substrate 52, as seen in FIGS. 3 and 4. Formed within the lower layer 64 of substrate 52 is a first field plate 66 to which a control voltage is applied. A second field plate 68 is similarly located within the upper layer 62 of substrate 52, and is also connected to a control voltage supply (not shown). The first field plate 66 is electrostatically spaced apart from and attractable to the bottom surface 70 of the switch body 58, whereas the second field plate 68 is electrostatically spaced apart from and attractable to the top surface 72 of switch body 58.

A first signal transmission line 74 is established through the lower layer 64 of substrate 52 through contacts 76 separated by a gap 78 therebetween, and defining a open circuit in the first signal transmission line 74. A second signal transmission line 80 is similarly established through the upper layer 66 of substrate 52 through contacts 82 separated by a gap 84, and defining an open circuit in the second signal transmission line 80.

The configuration of the switch 50 in the illustrated embodiments represents a double pole, double throw switch; however, the principals of the invention are applicable to other switch configurations as well. In the present embodiments, switch 50 can be implemented as either a two position switch or a three position switch. In order to maintain a third switch position, the body 58 of switch is maintained in position which is electrically disconnected from signal transmission lines 74, 80, and between the upper and lower substrate layers 62, 64. The embodiment shown in FIG. 3, for example, features a pair of hinges 90, which are used to bias switch 50 in a neutral or "off" position. The hinges 90 may be integrated with the conducting material.

Alternatively, a "free floating" switch design, shown in FIG. 4, may be utilized in the absence of hinges 90. However, in order to maintain switch 50 in a neutral third position, the first and second field plates 66, 68 are biased with an appropriate balancing charge such that the resulting opposing electrostatic forces exerted on the switch body 58 cancel one another out, thereby keeping switch body 58 suspended in a free floating position. In the absence of biasing electrostatic forces, switch 50 may also be used in a two position configuration, or a binary mode of operation. As an example of such a configuration, the first transmission line gap 78 is closed and the second transmission line gap 84 is open in the default or "off" position. In the energized or "on" position, the first set transmission line gap 78 is opened and the second transmission line gap 84 is closed.

Switch 50 is actuated by a control voltage selectively applied to one of the desired field plates. The resulting electrostatic force between the selected field plate and the switch body 58 either raises or lowers the body, depending upon which field plate is energized. If, for example, the first field plate 66 is energized, and further assuming that switch 50 is initially in a neutral position, switch body 58 will then be caused to move downward, until conducting surfaces 91 on opposite sides of the switch body 58 mate with corresponding contacts 76 on lower substrate layer 64, thereby closing the first transmission line gap 78 and defining a closed circuit. When the first field plate 66 is subsequently de-energized, switch body 58 may be returned to a neutral position by biasing hinges 90 or by the application of balancing charges on both first and second field plates 66, 68. In either case, the first signal transmission gap is reopened upon the separation of contacts 76 with the conducting surfaces on switch body 58.

The gap in the second signal transmission line 80 is closed in the same manner by energizing the second field plate 68. This time, the electrostatic forces generated cause switch body 58 to move in an upward direction until conducting surfaces 91 mate with contacts 82 on upper substrate layer 62. The second signal transmission line 80 is in a closed circuit condition until the second field plate 68 is deenergized and the switch body 58 is returned to a neutral position. It should also be noted that the polarity of the charge applied to either field plates may be reversed, thereby creating a repulsive force on switch body 58. The repulsive force provided by one field plate may also be used in conjunction with an attractive force provided by the other field plate, thereby creating a push-pull actuation mechanism.

Again, as an alternative to a three position embodiment, switch 50 can be configured in a two position mode such that one field plate is energized when the other is de-energized and vice versa. In this manner, either the first or the second signal transmission line gap is continuously opened at any given time, but not both gaps simultaneously. In other words, switch body 58 is not statically maintained in a neutral position.

Figure 5:
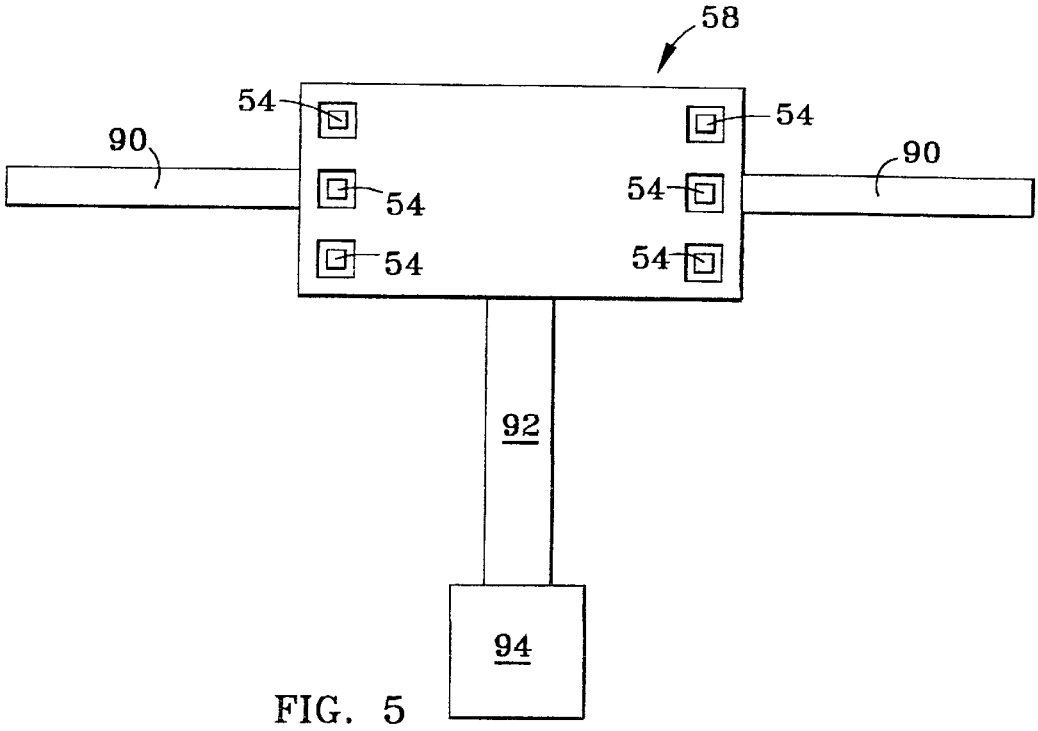
FIG. 5 is a top plan view of another embodiment of the micro electromechanical switch of the invention.

FIG. 5 illustrates yet another embodiment of the switch configuration, adaptable for use with a cantilever beam. In this embodiment, the main switch body 58 is integrally formed upon the end of a lever arm 92 which, in turn, is affixed to a stationary post 94 formed within the substrate. Lever arm 92 does not entirely support the weight of switch body, as hinges 90 are also used in this configuration.

Figure 6:
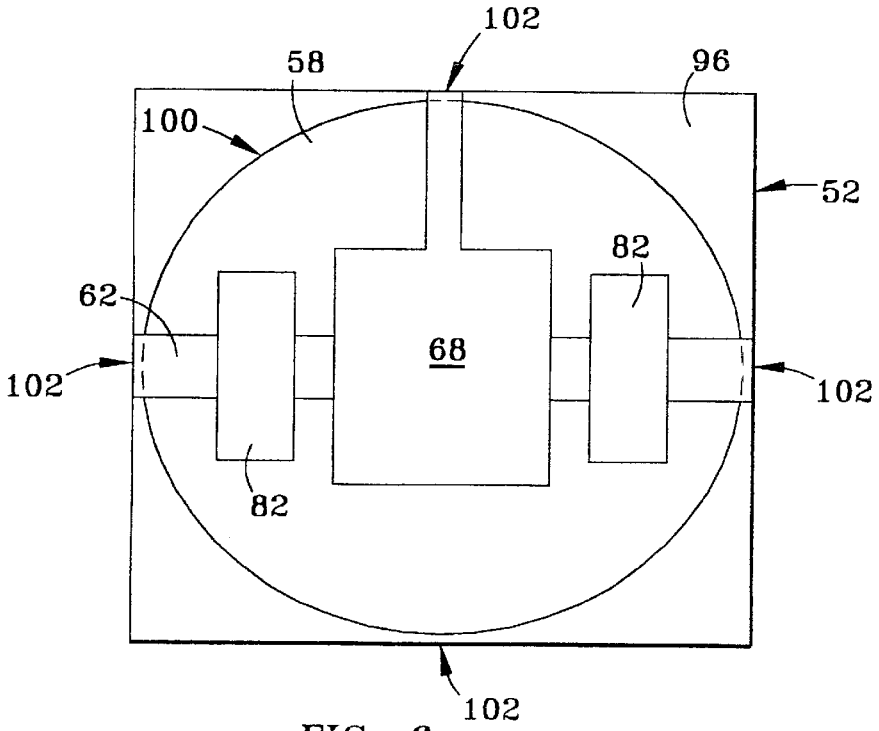
FIG. 6 is a top cross sectional view of another embodiment of the switch body.

FIG. 6 illustrates another embodiment of main switch body 58. As is shown, switch body 58 may be fabricated in a generally circular shape 100. Thus configured, switch body 58 travels vertically upward and downward within a cavity 96 formed within the substrate 52, while only frictionally engaging the substrate walls at four tangential surfaces 102 on switch body 58. Although guideposts (not shown) keep switch body 58 in a relatively horizontal orientation within cavity 96, via openings (not shown) do allow for slight lateral shifting of switch body 58 while in operation. Accordingly, with a circular design, there would be a minimal amount of surface contact between the outer edges of switch body 58 and the substrate walls defining cavity 96.

Figure 7:
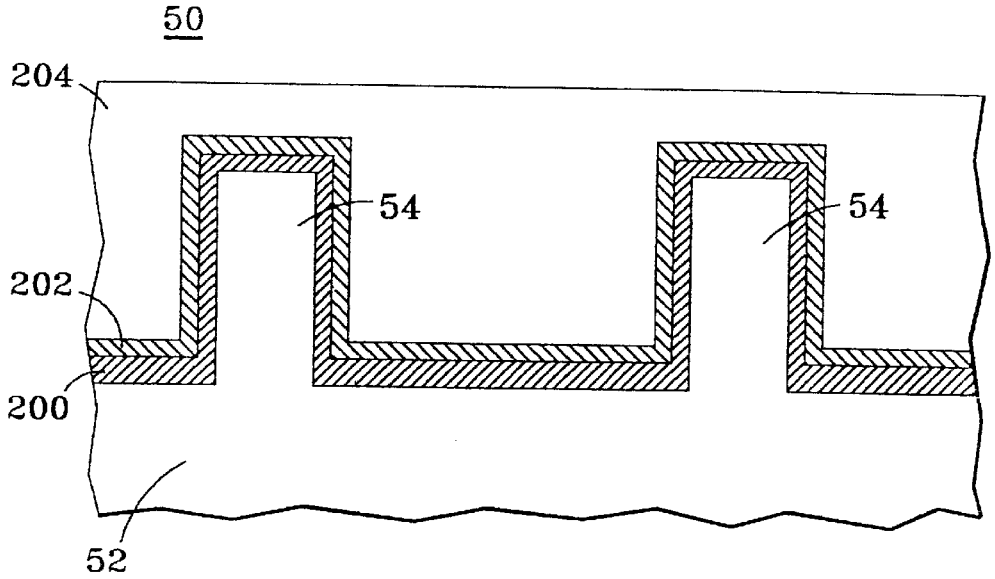
FIGS. 7–9 are cross sectional views of the steps in fabricating a section of the switch shown in FIGS. 3 and 4.
Figure 8:
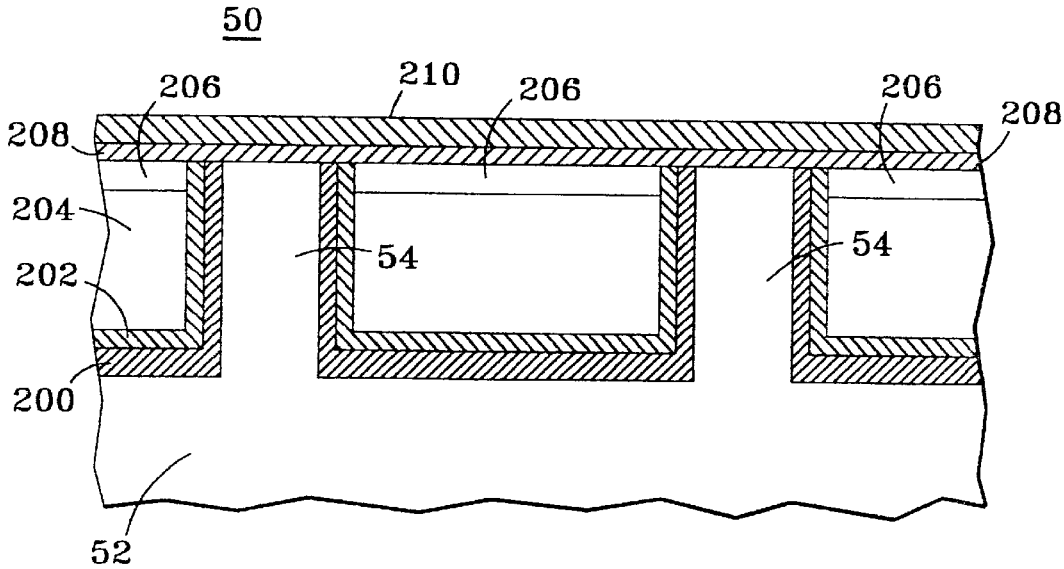

Referring now to FIG. 7, the details for fabrication of the switch are illustrated. The guideposts 54 are formed from the silicon dioxide ($SiO_2$) substrate 52 by known masking, deposition and etching techniques. A sacrificial layer 200, such as diamond-like carbon (DLC) or other conformal organic polymer, is deposited upon the substrate 52, including the side and top surfaces of the guideposts 54. A liner 202 is thereafter deposited upon the sacrificial layer 200, in order to prevent the diffusion of the electroplated copper 204 which is subsequently deposited upon the liner 202. Liner 202 is preferably comprised of a refractory metal such as titanium, titanium nitride, tantalum nitride or tungsten. Due to the poor corrosion resistance of copper 204, a cap 206 of cobalt-tungsten-phosphide (CoWP) is electrolessly formed upon the top surface of the copper layer, as shown in FIG. 8. It should be noted, however, that other materials may be used for cap 206, including tantalum nitride or nickel. The top of the cap 206 is planarized with the top surface of the guideposts 54, following chemical-mechanical polishing. A second sacrificial layer 208 of DLC is then deposited upon the caps 206 and the guideposts 54. Next, a top cap 210 of insulating material, preferably silicon nitride, is deposited upon the second layer 208 of DLC.

Figure 9:
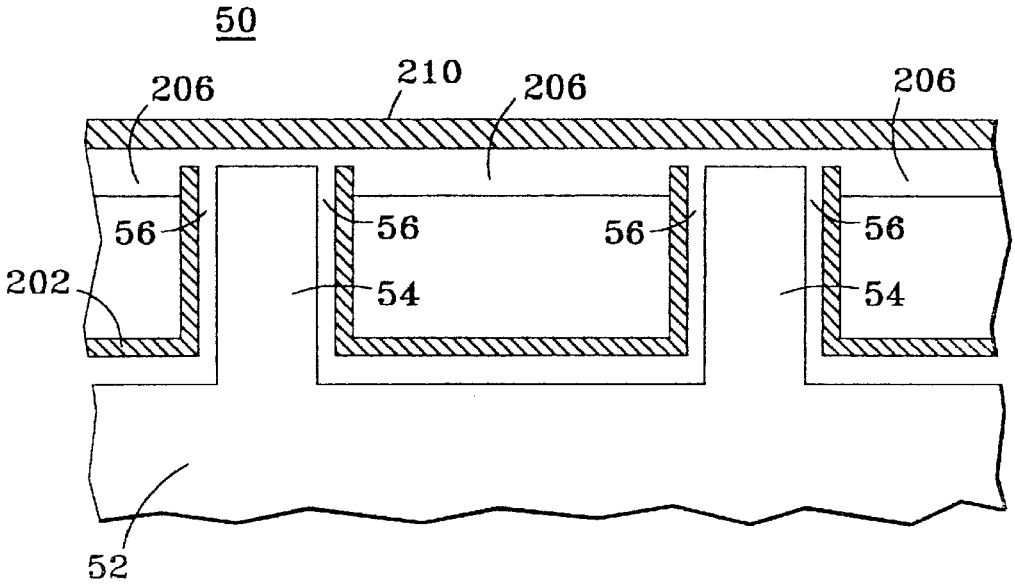

Finally, FIG. 9 illustrates the switch following the removal of the sacrificial layers 200, 208 of DLC. Upon forming a number of perforations in the top cap 210, the switch 50 is then heated in an oxygenated environment, thereby resulting in the removal of the sacrificial layers 200, 208 and producing carbon dioxide and carbon monoxide as waste gases. The removal of the DLC thus creates the via openings 56 in the switch body 58 through which guideposts 54 guide the vertical movement of switch body 58.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multi-position, micro electromechanical switch, comprising:

a plurality of guideposts formed upon a substrate;

a first signal transmission line, formed on a lower layer of said substrate, said first signal transmission line having a first gap defining an open circuit associated therewith;

a second signal transmission line, formed on an upper layer of said substrate, said second transmission line having a second gap defining an open circuit associated therewith; and a switch body having a plurality of via openings formed therein, said switch body movably disposed along said guide posts through said via openings.

2. The micro electromechanical switch of claim 1, further comprising a pair of supporting hinges, disposed on opposing sides of said switch body, said supporting hinges biasing said switch in a neutral position, wherein said gaps in both of said first and second transmission lines remain open.

3. The micro electromechanical switch of claim 1, wherein said switch body is generally rectangular shaped.

4. The micro electromechanical switch of claim 1, wherein said switch body is generally circular shaped.

5. The micro electromechanical switch of claim 1, wherein said switch body comprises electroplated copper.

6. The micro electromechanical switch of claim 5, wherein said switch body further comprises a cobalt-tungsten-phosphide (CoWP) insulating cap.

7. The micro electromechanical switch of claim 1, further comprising:

a first field plate formed on said lower layer of said substrate, said first field plate aligned electrostatically attractably apart from a bottom surface of said switch body; and a second field plate formed on said upper layer of said substrate, said second field plate aligned electrostatically attractably apart from a top surface located on said switch body.

8. The micro electromechanical switch of claim 7, further comprising a balancing charge applied to said first and second field plates, said balancing charge causing an electrostatic attraction between said first field plate and said bottom surface of said switch body to be cancelled by an electrostatic attraction between said second field plate and said top surface of said switch body.

9. The micro electromechanical switch of claim 7, wherein an electrostatic attraction between said first field plate and said bottom surface of said switch body causes said switch body to close said first gap in said first signal transmission line.

10. The micro electromechanical switch of claim 7, wherein an electrostatic attraction between said second fieldplate said and top surface of said switch body causes said switch body to close said second gap in said second signal transmission line.

* * * * *